US005258817A

United States Patent [19]

Acquaviva

[11] Patent Number: 5,258,817

[45] Date of Patent: Nov. 2, 1993

[54] DOCUMENT HANDLING SYSTEM HAVING A SHUNT PATH

[75] Inventor: Thomas Acquaviva, Penfield, N.Y.

[73] Assignee: Xerox Corporation, Stamford, Conn.

[21] Appl. No.: 907,273

[22] Filed: Jul. 1, 1992

[51] Int. Cl.[5] ..... G03G 21/00

[52] U.S. Cl. ..... 355/320; 271/3.1; 355/325

[58] Field of Search ..... 355/320, 308-309, 355/318-319, 325; 271/3-5, 301, 321

[56] References Cited

U.S. PATENT DOCUMENTS

| | | | |
|---|---|---|---|
| 4,941,023 | 7/1990 | Holmes et al. | 355/319 |
| 5,012,296 | 4/1991 | Dinnissen et al. | 355/320 |
| 5,083,769 | 1/1992 | Young, Jr. | 271/280 |
| 5,087,979 | 2/1992 | Schaertel | 358/296 |
| 5,105,283 | 4/1992 | Forest et al. | 358/401 |
| 5,122,840 | 6/1992 | Maeyama | 358/320 |
| 5,133,048 | 7/1992 | Parsons et al. | 395/111 |

*Primary Examiner*—A. T. Grimley
*Assistant Examiner*—Thu Dang

[57] ABSTRACT

A document handling system and method for automatically and successively transporting documents is provided. The system includes a primary path and means feeding documents in a predetermined sequence along the primary path from a stack of documents. The document handler system also provides a means for transporting selected ones of the document along the path to an upstream portion of the primary path out of the sequence and means for returning the selected ones of the documents to the other fed documents so that the combined documents are arranged in a collated manner corresponding to the predetermined sequence. The method of the present invention includes the steps of feeding documents in sequence along the path from a stack of documents, diverting selected ones of the fed documents from the defined path to an upstream portion of the path output so that the combined documents are in sequence again. The invention includes a secondary or shunt path which acts as a buffer for holding sheet units previously passing through the processing station. The secondary path is arranged to permit selected return of ones of the documents in the secondary path to the processing station while providing sequential return of the documents to the primary path for transport to the sheet output. Thus, the document handling system and method provides for selective reprocessing of documents to promote job recovery operations.

20 Claims, 2 Drawing Sheets

DOCUMENT HANDLING SYSTEM HAVING A SHUNT PATH

FIELD OF THE INVENTION

This invention relates generally to a document handling system for transporting sheets to and from an image processing station and, more particularly, concerns document handling systems for sequentially transporting documents to and from image processing stations having selectable shunt or buffer loop paths permitting retransport of selected documents to and from the image processing station while maintaining document sequence at an output tray.

BACKGROUND OF THE INVENTION

Document handlers are well known, and, generally, such document handlers have a defined path through which sheet-like material is transported to and from one or more process stations. In image input devices, electrophotographic devices and like devices, document handlers are employed to sequentially transport image bearing sheet-like materials, generally known as documents, to and from an image input terminals, such as light-lens imaging system, raster input scanning terminal and the like, for recording the image into or onto another medium (e.g., an electronic medium, a photoconductive surface, etc.).

Document handlers of the type to which this invention relates have means for sequentially feeding individual documents from a document input station, to a document image processing station and then to a document output station. Document handlers used with copiers frequently are provided with a recirculating mode whereby stacked documents are withdrawn individually and sequentially (1–N or N–1) from a holding bin or tray input and passed to an imaging station and then are outputted to the holding tray for subsequent recirculation in the previous manner. Many document handlers also invert the documents so that a duplex document may be imaged on both sides. Document handlers generally associated with image storage image input terminals which store or retain the image in memory (e.g., an electronic medium, magnetic disk or tape, optical disk, and the like), generally, do not need the recirculation capacity as the stored image may be recalled from memory as needed. However, an inverter which provides means for duplexing documents or imaging both faces of such documents is a common feature in such machines. In any event, the prime function of document handlers is to transport in sequence documents from a stack of documents along a path through an image processing station for imaging the transported documents while maintaining the documents collated and in sequence, although the documents may be inverted and/or deposited in an inverse order (e.g., documents fed 1–N may subsequently be arranged N–1).

In scanner, copier, and duplicator devices with which document handlers are most frequently associated, the devices are often given tasks or jobs (e.g., to image a series of documents) which require transport of documents by the document handler. Occasionally in performing such jobs, a jam or other error occurs (e.g., a jam in the copy sheet path of a copier). With the occurrence of such error or shortly thereafter, the operation of the document handler, as well as the whole of the device, is often interrupted by a control signal. Correction and rectification of these errors is called job recovery. Job recovery frequently requires operator intervention to correct the problem in the portion of the device affected. Further, as is often the case, documents previously transported through the image processing station will have to be returned to the image processing station for processing.

Previously, job recovery processes were primarily a manual operation. In the advent of an error, an operator generally reviewed the situation and reordered the documents within the stack as needed so that circulation and imaging could then be recommenced with the proper ordering of documents. Another common manual job recovery process required discarding the partially completed job (i.e., purge the electronically stored images, copied sheets or the other like recorded media), reordering the documents in the initial position, clearing or resetting any program and restarting the process or job from the beginning. Certain automation has improved these methods of job recovery, for example, many document handlers now provide automated recirculation of all documents in the stack with imaging recommencing after an almost complete recirculation of all documents. As should be evident from the foregoing, it is essential that the document stack must be returned to the position just prior to the interruption or the interruption as corrected (e.g., the return to the start after discarding the partial job) before resumption of the image processing to thereby reduce the incidents of skipping, multiplicity or misordering of pages.

These methods of job recovery or solutions for resuming operation of document handlers are wasteful of time and resources as they require undue operator intervention and are wasteful of machine time as well. This is particularly apparent in larger document handlers which have a document capacity which exceeds twenty five documents and becomes increasingly obvious in larger handlers which now can have capacities which exceed two hundred documents.

The following disclosures may be relevant to various aspects of the present invention:

U.S. Pat. No. 4,941,023
Patentee: Holmes et al.
Issued: Jul. 10, 1990

U.S. Pat. No. 5,012,296
Patentee: Dinnissen et al.
Issued: Apr. 30, 1991

U.S. Pat. No. 4,941,023 discloses a document handler for use with a copying machine to permit nonlinear paper sequencing. The document handler has three paths: an input path connecting the input tray with the imaging station, an output path with a selectable document inverter connecting the imaging station with the output tray and a bypass path interconnecting the input and output paths so that documents after imaging and inversion can be returned to the imaging station immediately after imaging of only one intervening document. The patent also discloses a similar return path for copy sheets. Thus, a document and a copy feeder is disclosed which returns inverted documents and copy sheets after having an image made of a document and fixed on a first side of a copy path for imaging of the documents and transferring and fixing a second image to the opposite side of the copy sheet. In the return path only one intervening copy sheet or image pitch separates the first and second image transfer to a copy sheet. The patent discloses, in essence, a means for making relatively rapid duplex sheets so that long endless loop copy paths and/or buffers are not needed yet also provides relative efficient duplexing (few wasted image pitches).

U.S. Pat. No. 5,012,296 discloses a printing machine for producing duplex copying images essentially having the same type of document handling bypass loop between the inversion portion of the output path and the input path to the imaging station as that of U.S. Pat. No. 4,941,023. The patent further discloses that the copier portion of the device has an increased length of travel in the path between fixing on a first side of a sheet and return of the sheet for transfer to the opposite side so that each document is imaged twice on a side before exiting the imaging station.

All of the above described patents suffer, as stated above, from various deficiencies. But, specifically, they fail to teach or provide for reducing the inefficiency and errors in job recovery operations and for automating job recovery operations in copying, scanning and printing devices having document handlers. Consequently, and particularly in view of the larger capacity of input bins or trays for document handler systems of present devices which can now handle in excess of 200 document sheets, there exists a need to reduce operator errors in job recovery operation as well as improving the overall efficiencies of document handlers.

Pursuant to one aspect of the present invention, a document handler has a primary document path and means for successively feeding along the primary path individual documents in a predetermined sequence from a stack of documents. Means for transporting selected ones of the documents fed along the path to an upstream portion of the path out of the sequence and means for returning the selectively transported documents to the other fed documents so that the combined documents are arranged in a collated manner corresponding to the predetermined sequence.

Pursuant to another aspect of the present invention, there is provided a method for document handling and job recovery which includes feeding individual documents in sequence along a defined path which includes an input and output station and an image processing station. The method includes diverting selected ones of the fed documents from the defined path subsequent to the processing station back to the processing station. The method also includes the step of reintegrating the selected ones of the documents with the unselected documents so that the combined documents at the output station are in a collated sequence thereat.

Thus, the present invention provides a relatively simple, inexpensive and effective means for reducing errors and increasing efficiency in job recovery situations involving document handlers. Further, the invention provision of a secondary or alternative path to delay document delivery to the output bin does not significantly decrease the actual throughput of the device and does ease and speed job recovery.

While the present invention will be described in connection with the preferred embodiment thereof, it will be understood that it is not intended to limit the invention to that embodiment. On the contrary, it is intended to cover all embodiments, modifications, and equivalents as may be included within the spirit and scope of the invention as defined by the appended claims. For a general understanding of the features of the present invention, references should be made to the drawings. In the drawings, like numerals have been used to identify identical elements.

BRIEF DESCRIPTION OF THE DRAWING

Other aspects of the present invention will become apparent as the following description proceeds and upon reference to the drawings, in which.

DESCRIPTION OF THE PREFERRED EMBODIMENT

Figure 2:
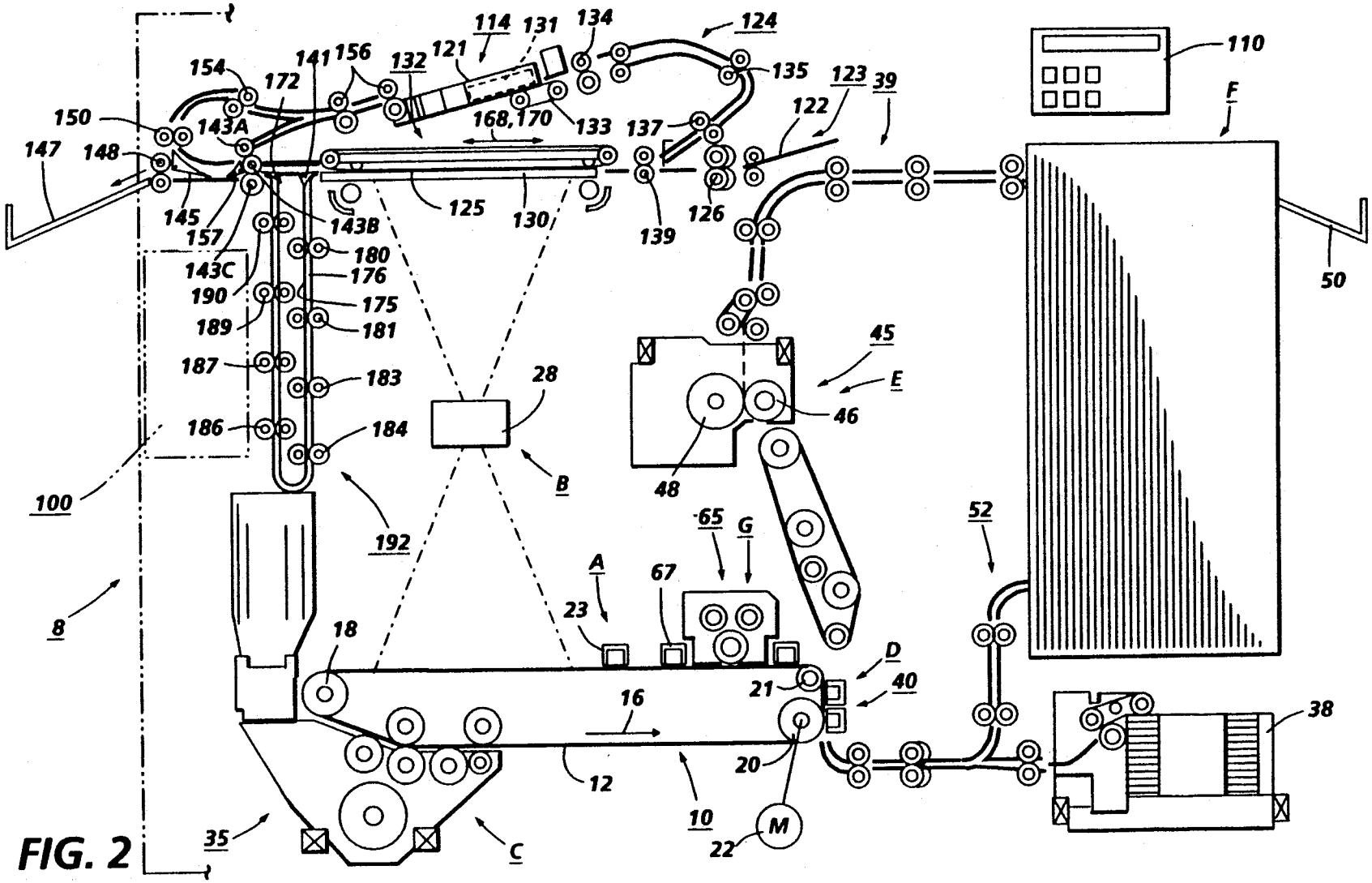
FIG. 2 is a schematic elevational view depicting an illustrative electrophotographic printing machine incorporating the preferred embodiment of the present invention.

FIG. 2 schematically depicts an electrophotographic printing machine incorporating a document handler embodying the features of the present invention therein. It will become evident from the following discussion that document handling apparatus of the present invention may be employed in and with a wide variety of systems and is not specifically limited in its application to the particular embodiment depicted herein.

Referring to FIG. 2 of the drawings, an illustrative electrophotographic printing machine 8 includes a conventional photoreceptor belt 10 and conventional xerographic stations acting thereon: charging station A, imaging and exposing station B, developing station C, transferring station D, fusing station E, finishing station F, and cleaning station G. The belt 10 moves in the direction of arrow 16 to advance successive portions of the photoconductive surface 12 of the belt 10 sequentially through the various processing stations disposed about the path of movement of this illustrative electrophotographic printing machine. Belt 10 is entrained about by a tension roller 18, drive roller 20 and stripper roller 21. The drive roller 20 is rotationally actuated by a motor 22 by suitable means such as a belt drive.

As roller 20 rotates, it advances the belt 10 in the direction of the arrow 16. Thus, a portion of the photoconductive surface 12 passes through a charging station A. At changing station A, the portion of photoconductive surface 12 proximate the station is charged to a substantially uniform potential. As shown in this example, station A comprises a corona generating device 23 which charges the surface to a relatively high potential.

As the belt 10 advances, the charged portion then passes to an imaging station B. At imaging station B, a document handling unit 114 delivers documents to an imageable position on a platen 130 for imaging the document. In the exemplary printing machine, the imaging station B exposes the photoconductive surface 12 to form a latent image thereon as shown in the exemplary printing machine, through the schematically depicted light-lens optical input/output system 28. It will be understood that the light-lens system 28 could be replaced by any conventional raster input scanner and raster output scanner to image the documents and expose the surface 12.

The portion of the photoconductive surface 12 bearing the latent image then advances to the development station C. At development station C, development of the latent image occurs with the application of toner material to the surface. In this case, a magnetic brush developer unit 35 delivers the developer material proximate to the latent image. The toner material electrostatically adheres to the imaged areas to form the developed image on the photoconductive surface 12. The developed toner image advances to the transfer station D, as the belt continues in the direction 16. At transfer station D, the image on the belt contacts a copy sheet supplied from copy input tray 38 by sheet handling system 39. Corona generators 40 apply a charge to the copy sheet to attract the toner of the developed image. After the toner image is transferred to the copy sheet, the sheet handler advances the copy sheet with the transferred toner image thereon to a fusing station E.

The fusing station E includes a fuser assembly, generally indicated by reference number 45 which affixes the toner powder on the copy sheet. The fuser assembly 45 includes a heated fuser roller 48 and a roller 46 so the toner image permanently bonds to the copy sheet. The sheet handling system 39 after directing sheets through the fusing station E directs such sheets to a finishing station F and eventually to an output tray 50. The finishing station F can include binding or stapling or the like processing, as is well known in the art. Further, as shown, the finishing station F can include a return 52 with an invertor for two sided copies i.e., so-called duplex copies, as is also well known in the art.

The portion of the photoconductive surface 12, after passing the transfer station E where the developed image was transferred, advances to a cleaning station G. The cleaning station G removes residual toner particles and other such material remaining on the photoconductive surface 12. As shown here, cleaning station G includes a mounted fibrous or electrostatic brush unit 65 which contacts the photoconductive surface 12 to clean it. A discharge corona generating device 67 is often placed proximate the unit 65 and upstream station A to dissipate residual charges remaining on the photoconductive surface to prepare it for the next successive imaging cycle beginning with station A, the charging station.

As is conventionally practiced, the entire document handler system 114 is pivotally mounted to the printing machine 8 so as to be liftable by the operator away from its active position adjacent the platen. Lifting the document handler away from the platen 130 permits manual document placement on the platen, as well as convenience clearance of jams occurring in the transport system proximate to the platen. The document handler system has external covers to cover the moving parts which are not shown here for clarity.

The machine functions described and other machine functions to be described or as may be useful are regulated by a controller 100. The controller is preferably a programmable microprocessor which controls all necessary machine functions described previously. The controller also provides through known means comparison counts of copy sheets, numbers of documents imaged, recirculated, and otherwise processed by the document handler 114, numbers of copy sheets selected by the operator, time delays, jams and the like. Control of all exemplary systems described may be accomplished by conventional control switches input from the printing machine console 110 as selected by the operator. Further, document and copy sheet path sensors and/or switches may be utilized to keep track of the position of documents and sheets moving in their respective paths so as to recognize jams and other problems requiring extraordinary measures. In addition, controller 100 regulates the various positions of gates within the system to be described in further detail. Thus, for example, by operator selection of the documents to go to station F for binding or stapling or other specialized functions or the output tray 50, the controller 100 will actuate a decision gate to effect such choice.

Figure 1:
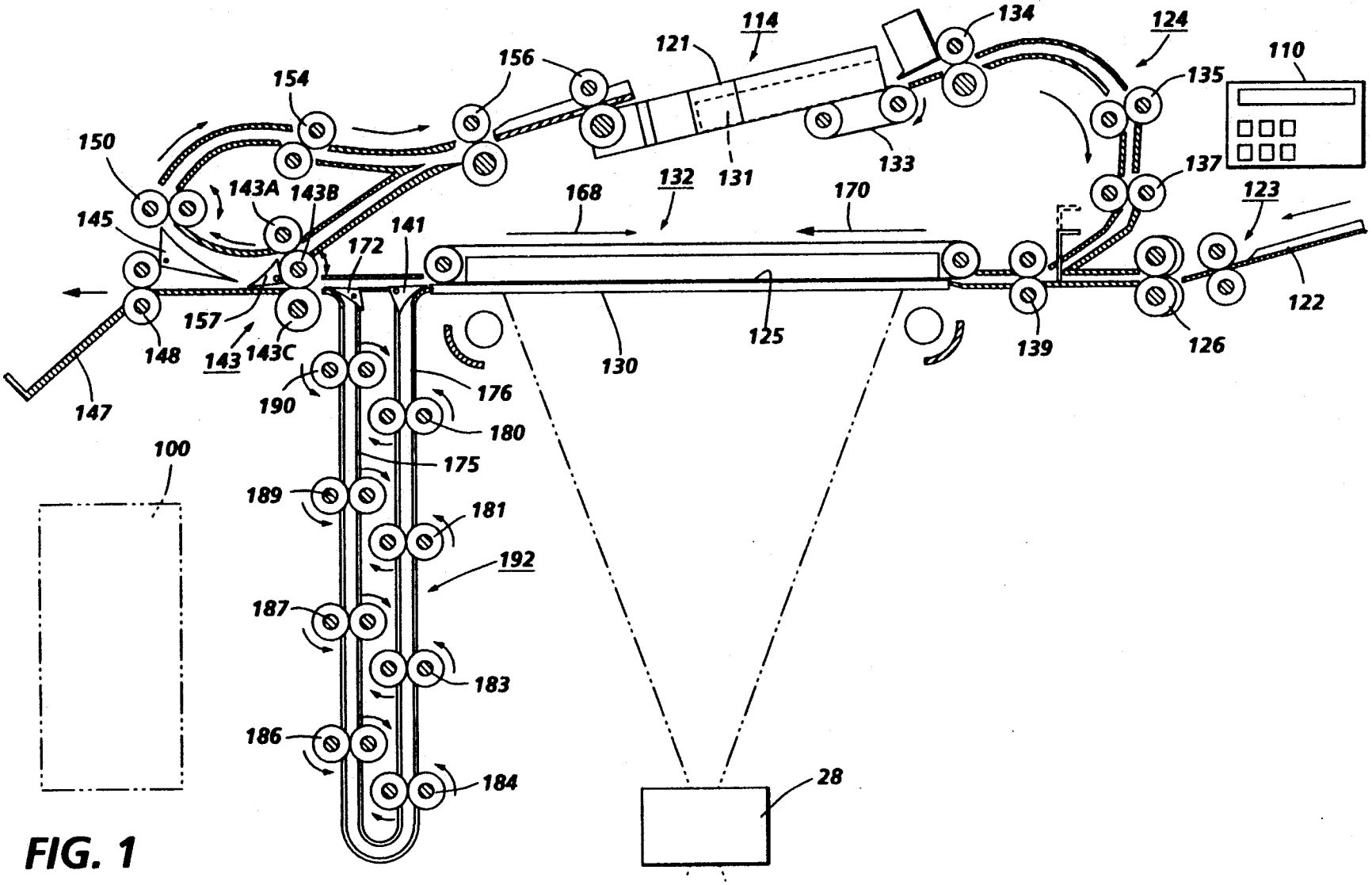
FIG. 1 is a side elevational view of the preferred embodiment of the present invention.

Referencing FIG. 1, the features of the present invention will now be described in greater detail. As shown in FIG. 1, document handler unit 114 for transporting documents successively to and from an image processing station provides efficient and semi-automatic job recovery means thereby improving the effectiveness and efficiency of automatic document handlers without necessitating undue operator intervention. It will become evident from the following discussion that document handling apparatus of the present invention may be employed in and with a wide variety of systems and is not specifically limited in its application to the particular embodiment depicted herein.

In the document handling system 114 of FIG. 1, there is a input stacking tray 121 for automatic document system 124 and a side entrance shelf 122 for semiautomatic document system 123 into which documents may be individually inserted. The automatic document handler system 124 of the document handling system 114 provides for automatic transport of successive registered and spaced document sheets onto and over a conventional platen imaging station 125. The imaging station shown employs a friction belt platen transport system 132 overlaying platen 130. In this example, documents are fed one at a time from the bottom of a stack of one or more documents 131 placed in the tray 121 by driven belt 133 to roller set 134, which directs documents to the friction belt transport system 132 for imaging via roller sets 135, 137 and 139. Documents input from the semiautomatic document system 123 are fed by roller sets 126 to the roller set 139 to the platen transport system 132.

Documents exiting the platen transport system 132 are then directed to a gate 141, which when in a first position permits passage of documents to the lower two rollers 143B and 143C of the three roller set 143. When documents are fed from the semi-automatic shelf 122, gate 141 is, generally, in the first position and decision gate 145 is also in a first position, so documents exiting the transport system 132 are directed to output tray 147 via roller set 148 and the rollers 143B and 143C. In some instances documents fed from semi-automatic shelf 122 are to be, for example, duplexed or interspaced with documents in the automatic system 124. In these cases such documents, after exiting the platen transport system 132, are directed as documents from the input tray 121 are directed, as is more fully explained below.

Documents input from the tray 121 after passage from the platen transport system 132 are directed to the gate 141, which when in the first position, directs the documents to rollers 143B and 143C of roller set 143. In such cases, the decision gate 145 is positioned in its second lower position to direct documents to roller set 150 which can rotate in a first direction to receive documents from the rollers 143B and 143C and then either direct the documents to rollers 154 or reverse rotation to redirect the document back to the gravity gate 157, which when documents are directed back from the roller set 150 directs such documents toward the nip between the roll 143A and the roller 143B of the roller set 143. Documents passing through the rollers of roller set 143A and 143B and those passing through the rollers 154 are directed to the tray 121 via roller sets 156 with those passing through the rollers 143A and 143B being inverted.

As is common practice, each of the roller sets in the above-described system contain a drive roller and at least one idler roller. Further, while registration means have not been specifically discussed herein, it is well known to include such devices, such as cross rolls, registration edges and the like, to provide registered presentation of the documents as appropriate. In the present system, the roller set 143 is driven by a reversible drive roller 143B. Thus, documents within the nip between rollers 143B and 143C when the roller 143B is driven in a reverse rotational manner are urged toward the platen transport 132. Further, the transport 132 in this embodiment is capable of rotation in the directions indicated by arrows 168 and 170 to permit urging documents in a forward and reverse direction relative to document travel from the tray 121. Documents returned to the platen by the reverse rotation of the roller set 143B and the transport 132 are, after presentation for imaging, urged by the forward rotation of the platen transport and the roller 143B and 143C to roller set 150 and then ultimately to the tray 121 by the direct or inverted path, as selected. As apparent, the described arrangement of rollers provide for both simplex and duplex imaging of documents placed in tray 121, as well as permitting reimaging of documents previously imaged.

The overall function and features of this invention will now be explained in greater detail. As should be recognized, the document handler system in FIG. 1 has a secondary bypass loop means defined in the document handler system 114 between the gate 141 and gate 172 by the guide ways 175 and 176 and roller sets 180 and 181, 183 and 184, 186 and 187 and 189 and 190. Thus, the guide ways and the roller sets define shunt path 192. In the specific system of FIG. 1, gate 141 is an actuator gate having a first closed position and a second open position for directing documents passing from the platen transport 132 into the shunt path 192. Gate 172 is a gravity gate which opens as a document from the shunt path contacts it, directs a document passing it toward rollers 143B and 143C, and closes after the document is returned to the primary path. The roller sets 180 and 181, 183 and 184, 186 and 187, and 189 and 190 are spaced to hold standard documents in each of the designated sets and are spaced to permit passage of documents between sets. The controller 100 provides signals to position decision gate 141. Further, the controller 100 emits signals to increment roller sets to advance documents between the sets, generally, at the rate where documents in the shunt path are advanced to the imaging station.

Thus, in this case when the shunt loop is open (i.e., gate 141 is in the second, open position) and four documents have been imaged, the four imaged documents will be resident in the bypass loop, while a fifth document is imaged. Then, upon the imaging of the fifth document, the first imaged document will be reintroduced into the primary path and directed to the nip between rollers 143B and 143C. The drive roller of roller set 143B, after receiving the document and driving the document a distance to permit closure of gate 172. in response to signals generated by the controller 100 indicative of the selected travel for the first document and the exiting of the shunt loop either (1) reverses rotational direction and, thus, direct the document toward the gate 141 and the platen transport 132 or (2) continues to direct the document forward along the primary path to roller set 140 and ultimately tray 121. If the document is urged in the reverse direction toward the decision gate 141, control signals are also provided by controller 100 to place gate 141 in its closed position and to actuate the platen transport 132 in the direction indicated by the arrow 170.

Thus, in this exemplary automatic document handler 124 the document stack are fed N-1 with documents as follows: (N . . . H, G, F, E, D, C, B, A, . . . , 1). To further explain this invention assume documents G, F, E and D have entered the shunt path of the buffer loop means passing gate 141, document C is on the platen and in the document tray 121 are documents B-1 waiting to be fed and documents H-N having been imaged are in the tray when an error signal which interrupts the document feeding is transmitted by the controller 100. For this example, the signals also indicates that document E was the last document properly processed and reimaging should commence with document D.

Thus, after the intervention of the operator to correct the problem, as indicated on user interface panel display 110, the feeding of documents could commence again to complete the job recovery process. In this instance, document G would be fed from the shunt path to the rollers 143B and 143C while the documents F, E and D are incremented in the shunt path and document C enters the shunt path. Document G would be directed back to tray 121 via either the primary non-inverting or inverting path as preselected. Likewise, documents F and E would be successively fed out of the shunt path and back to the tray while documents D and C are incremental in the shunt path.

After document D is fed to roller set 143 and past gate 172 so that the gate closes, the roller direction of drive roller 143B is reversed and gate 141 is positioned in the close position so that document D is directed to the platen transport system 132. The transport system is actuated in its second reverse direction to transport the document D to an imaging position on the platen at which time the platen transport system is stopped for imaging. The platen transport system is then actuated in its first forward direction indicated by arrow 168 to drive the document D past the closed gates 141 and 172 to the nip between the lower two rollers 143B and 143C of roller set 143. The rollers 143B and 143C direct the document D to the roller set 150 which drive the document toward roller set 154 until the trail edge of document D is beyond gravity gate 157, which then closes. At this time, the direction of rotation of the roller set 150 is then implemented to drive the document in the original preselected direction for document D (e.g., if the initially selected document path is non-inverted to roller set 154 and if inverted to the two upper rollers 143A and 143B). Likewise, document C is transported out of the loop to the rollers 143B and 143C, back on to the platen 130 for imaging and then to tray 121. Document transport from tray 121 would then be recommenced with the transport of document B to the imaging position of the platen 130, and then the remaining documents A-1 would be transported in sequence to complete the job or job segment.

It will be further understood from this description that the shunt path disclosed in the preferred embodiment is selectable. That is, the gate 141 may in certain cases be closed so that the shunt path is inactive and in others open. In jobs involving smaller numbers of documents the use of the shunt path may not be necessary. It is also contemplated that an operator switch may be provided on the panel 110 which activates the path by opening gate 141 or overrides the selection of the machine controller 100. From the foregoing it should also be appreciated that the present invention is suited generally for larger capacity document handlers having a capacity of 25 or more documents and that it is generally implemented in jobs having 25 or more documents. A document height or weight sensor can be disposed in the document tray 121 and connected to the controller 100 to provide signals to open and close the gate 141 according to the state of the signal from the detector in tray 121.

Thus, as should be clear, in the embodiment of FIG. 1, the control signals for the document handler operation are provided by the machine controller 100. The controller 100 preferably comprises a known programmable microprocessor system, as exemplified by extensive prior art, e.g., U.S. Pat. No. 4,475,156 and its references. Plural but interconnecting microprocessors may be used include at different locations of the document handler and devices with which the document handler is associated. It is contemplated that the controller 100 controls all of the machine steps and functions described herein, including all document feeding. This includes the operations of the document handler 114: decision gates 141, 145, feeder belt drive 133 and the drive rolls of the roller sets, etc. As further taught in those references, the controller 100 also conventionally provides for storage and comparison of the counts of the document sheets, the number of documents fed and recirculated in a document set, and other selections by the operator through a connecting panel of control switches on the panel 110. This information storage and comparison capacity coupled with error detection for occurrences, such as misfeeds and system errors in the devices associated with the document handler, enables job recovery. Thus, job recovery commences with the return of successfully imaged documents to the document tray 121 from the shunt path 192, continues with the return to the imaging station of documents requiring reimaging and subsequent transport to the document tray 121, and, finally, ends with the resumption of standard document transport and imaging so that the document sequence at the tray is maintained.

Further, the controller controls and tracks the position of the documents and the operative components of the apparatus by their connection to the controller. For example, the controller may be conventionally connected to receive and act upon jam, timing, positional, and other control signals from various sensors in the document path as well as errors in imaging or other portions of the devices associated with the document handler 24, such as the copy sheet path of an electrophotographic printing machine. The controller automatically actuates and regulates the positions of document path selection gates depending upon which mode of operation is selected and the status of the device. The controller 100 also conventionally operates and changes displays on a connecting instructional display panel 110 which preferably includes said operator selection buttons or switches to enable an operator to select functions and override controller selections, as appropriate.

In the event of an error requiring job recovery, the employment of the shunt path means of the present invention promotes efficient and effective job recovery operations in devices having automatic document handlers. The present device permits reintroduction of previously imaged documents to the imaging area on the platen for imaging without loss of the preselected sequence of the document stack, without undue operator intervention and with minimal operator and machine losses. That is, the requirements to recirculate the stack of documents and recommence imaging at the document upon which the error occurred; to eliminate all prior results, reset the stack and commence at the beginning of the stack; or to stack the documents in the bin in an order reflecting the partial job completion and enable commencement with the next document to be imaged, are eliminated.

In recapitulation, a document handler suitable for use with image scanners, printers, copiers and other devices having image processing apparatus has been disclosed. The document handler has a primary path through which documents are transported to and from a processing station. A secondary or shunt path with entry and exit ports in the primary path is provided. Thus, in cases where relatively large volumes of documents are to be transported to and from an imaging station, a selectable shunt path auxiliary or buffer path can be opened so sheets after passing the image processing station would be accumulated for sequential dispensement or for retransport to the image processing station for job recovery.

It is, therefore, apparent that there has been provided in accordance with the present invention, a document handling device that fully satisfies the aims and advantages hereinbefore set forth. While this invention has been described in conjunction with a specific embodiment thereof, it is evident that many alternatives, modifications, and variations will be apparent to those skilled in the art. Accordingly, it is intended to embrace all such alternatives, modifications and variations that fall within the spirit and broad scope of the appended claims.

I claim:

1. A document handler, comprising:

a) means for defining a primary document path;

b) means for successively feeding along the primary document path in a first direction documents in a predetermined sequence from a stack of documents;

c) means for transporting selected ones of the documents fed along the primary document path in the predetermined sequence to an upstream portion of the primary document path out of the predetermined sequence; and d) means for reintegrating the selected ones of the documents with unselected ones of the document in the primary document path so that the selected ones of the documents and the unselected ones of the documents are arranged in a collated manner corresponding to the predetermined sequence.

2. The document handler of claim 1, further comprising:

means for inverting the fed documents along the primary document path; and second means for transporting inverted documents to an upstream portion of the primary document path out of the predetermined sequence.

3. The document handler of claim 1, wherein said transport means includes means for defining a shunt path, a selectable gate in the primary document path actuable between a first closed position and a second open position for directing documents into the shunt path, means for actuating documents in the shunt path; and a second outlet gate in the shunt path for directing documents exiting therethrough to the primary document path.

4. The document handler of claim 3, wherein said transport means further includes second means for actuating the selected ones of the documents exiting the shunt path into the primary document path in a direction opposite that of said feed means.

5. The document handler of claim 4, wherein said feed means includes said reintegrating means so that the selected ones of the documents pass from a document imaging station to a document output station along the primary document path.

6. The document handler of claim 5, wherein said first mentioned actuating means actuates documents at a rate consonant with a rate documents are fed to the document imaging station by said feed means.

7. The document handler of claim 1, further comprising a document tray disposed adjacent a document input station wherein said document tray is adapted to receive and position documents proximate the document input station for feeding along the primary document path.

8. The document handler of claim 7, further comprising means for recirculating documents along the primary document path wherein documents exiting a document output station are received by said document tray.

9. The document handler of claim 1, wherein said defining means includes a document input station for receiving documents for feeding into the primary document path, a document imaging station for presenting documents for imaging, and a document output station for receiving the documents.

10. The document handler of claim 9, wherein said transport means transports ones of the selected documents from the primary document path downstream of the document imaging station to the document imaging station.

11. The document handler of claim 9, wherein said feeding means includes:

a) means for separating a document from the stack of documents disposed in said document tray;

b) a first plurality of rollers disposed along the primary document path to drive the documents from the document input station to the document imaging station;

c) means for urging the documents across the document imaging station; and d) a second plurality of rollers disposed along the primary document path to drive the documents from the document imaging station toward the document output station and said document tray.

12. The document handler of claim 11, wherein said transport means include means for reversing the rotation of said second plurality of rollers for driving the document from the document imaging station toward the document output station so that the selected ones of the documents are returned to the document imaging station from a portion of the primary document path downstream of the document imaging station.

13. A method for document handling and job recovery, comprising the steps of:

a) feeding documents, in a predetermined sequence, along a defined path;

b) diverting selected ones of the documents from the defined path to an upstream portion of the defined path out of the predetermined sequence; and c) reintegrating the selected ones of the documents with unselected ones of the documents in the defined path so that the selected ones of the documents and the unselected ones of the documents are in the predetermined sequence.

14. The method of claim 13, further comprising the step of inverting the unselected ones of the documents in the defined path.

15. The method of claim 14, wherein said inverting step also inverts the selected ones of the documents so that the selected ones of the documents and the unselected ones of the documents are collated in the predetermined sequence by said reintegrating step.

16. The method of claim 13, further comprising the steps of:

imaging documents passing along the defined path;

sensing documents requiring reimaging;

initiating said steps of diverting and of reintegrating to enable reimaging of the selected documents and to place the selected ones of the documents and the unselected ones of the documents in the predetermined sequence; and continuing the step of feeding documents along the defined path.

17. A document handling system having improved job recovery performance for use with devices having image input terminals comprising:

a) means for defining a document path having a document input station, a document imaging station, and a document output station;

b) means for feeding, in a sequence, documents from a stack of documents positioned proximate the document input station to and through the document imaging station and toward the document output station;

c) means for transporting selected documents from an output side of the document imaging station back to the document imaging station and then to the document output station so that the sequence of the feed of documents from the document stack is maintained at the document output station to thereby facilitate job recovery operations.

18. The document handler system of claim 17, wherein said transporting means includes a loop path positioned between the document imaging station and the document output station so that documents fed by said feeding means from the document imaging station toward the document output station enter said loop path.

19. The document handling system of claim 18, wherein said transporting means further includes means for selectively driving documents along said loop path.

20. The document handling system of claim 19, further comprising means for selectively directing ones of the documents exiting said loop path to the document imaging station and then the document output station and directing others of the documents exiting said loop path to the document output station to maintain document input sequence at the document output station.

* * * * *